US007186162B2

(12) United States Patent
Chiang

(10) Patent No.: US 7,186,162 B2
(45) Date of Patent: Mar. 6, 2007

(54) AQUATIC AMUSEMENT TOY

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 0 days.

(21) Appl. No.: 11/037,369

(22) Filed: Jan. 19, 2005

(65) Prior Publication Data

US 2006/0160460 A1 Jul. 20, 2006

(51) Int. Cl.
*A63H 23/00* (2006.01)
*B63B 22/18* (2006.01)

(52) U.S. Cl. ..... 446/153; 441/23

(58) Field of Classification Search ..... 446/153, 446/156, 161, 491, 404, 220, 71; 441/6, 441/23; 273/350, 459; 473/466
See application file for complete search history.

(56) References Cited

U.S. PATENT DOCUMENTS 2,791,062 A * 5/1957 Hirsch et al. ..... 446/156
4,563,161 A * 1/1986 Zimmerman ..... 446/156
4,976,641 A * 12/1990 D'Amico ..... 441/23
5,516,316 A * 5/1996 Rumminger ..... 441/1
6,332,822 B2 * 12/2001 Greenberg et al. ..... 446/153
6,431,931 B2 * 8/2002 Johnson ..... 441/6
6,913,505 B1 * 7/2005 Chiang ..... 446/153

* cited by examiner

*Primary Examiner*—Faye Francis
(74) *Attorney, Agent, or Firm*—Troxell Law Office, PLLC

(57) ABSTRACT

An aquatic amusement toy including a buoyant body and an underwater member. The buoyant has a housing including an engaging portion, a first protruding shell and a second protruding shell, and the underwater member has a first and second face and a receiving portion communicating through the first and second surface. The engaging portion of the buoyant body is engageable with the receiving portion of the underwater member. In use the buoyant body is coupled with the underwater member and sinks in water such that the first protruding shell or the second protruding shell keeps the buoyant body at a predetermined height above the bottom of water, and when the underwater member is depressed to disengage from the buoyant body, said buoyant body floats to the surface of the water and the underwater member remains immersed.

10 Claims, 7 Drawing Sheets

AQUATIC AMUSEMENT TOY

FIELD OF THE INVENTION

The present invention relates to an amusement toy, and particularly to an aquatic amusement toy having a buoyant body for floating on water after the aquatic amusement toy is depressed at an underwater member.

BACKGROUND

Swimming is not only a kind of wonderful sports but also a kind of activities for taking a summer holiday. More and more aquatic games are made and designed for fun, such as holding one's breath under water, walk race in water, treasure hunt under water, ball games in water.

A conventional game of treasure hunt under water is that a coin is thrown in water and swimmers dive into water to look for the coin. The guy who first finds the coin is the winner. However, it is monotonous to look for a coin under the water and it is inconvenient to pick up a coin under the water since the coin is quite small.

SUMMARY OF THE INVENTION

Accordingly, an object of the present invention is to provide an aquatic amusement toy, which is used for an aquatic game that combines the features of diving sport and amusement, and is a much vivid and funny aquatic amusement toy.

To achieve the above-mentioned objects, an aquatic amusement toy in accordance with the present invention comprises a buoyant body and an underwater member. The buoyant body includes a housing, a first protruding shell and a second protruding shell, and the underwater member has a receiving portion. Wherein, which are engageable or disengageable with each other.

In use, the buoyant body engages the underwater member and is sunk in water such that the first or the second protruding shell keeps the buoyant body at a desired height above the bottom of water, and when the underwater member is depressed for disengaging from the buoyant body thereby said buoyant body floats to the surface of the water and the underwater member remains immersed.

Other objects, advantages and novel features of the present invention will be drawn from the following detailed embodiment of the present invention when taken in conjunction with the accompanying drawings.

DESCRIPTION OF THE PREFERRED EMBODIMENT

Figure 1:
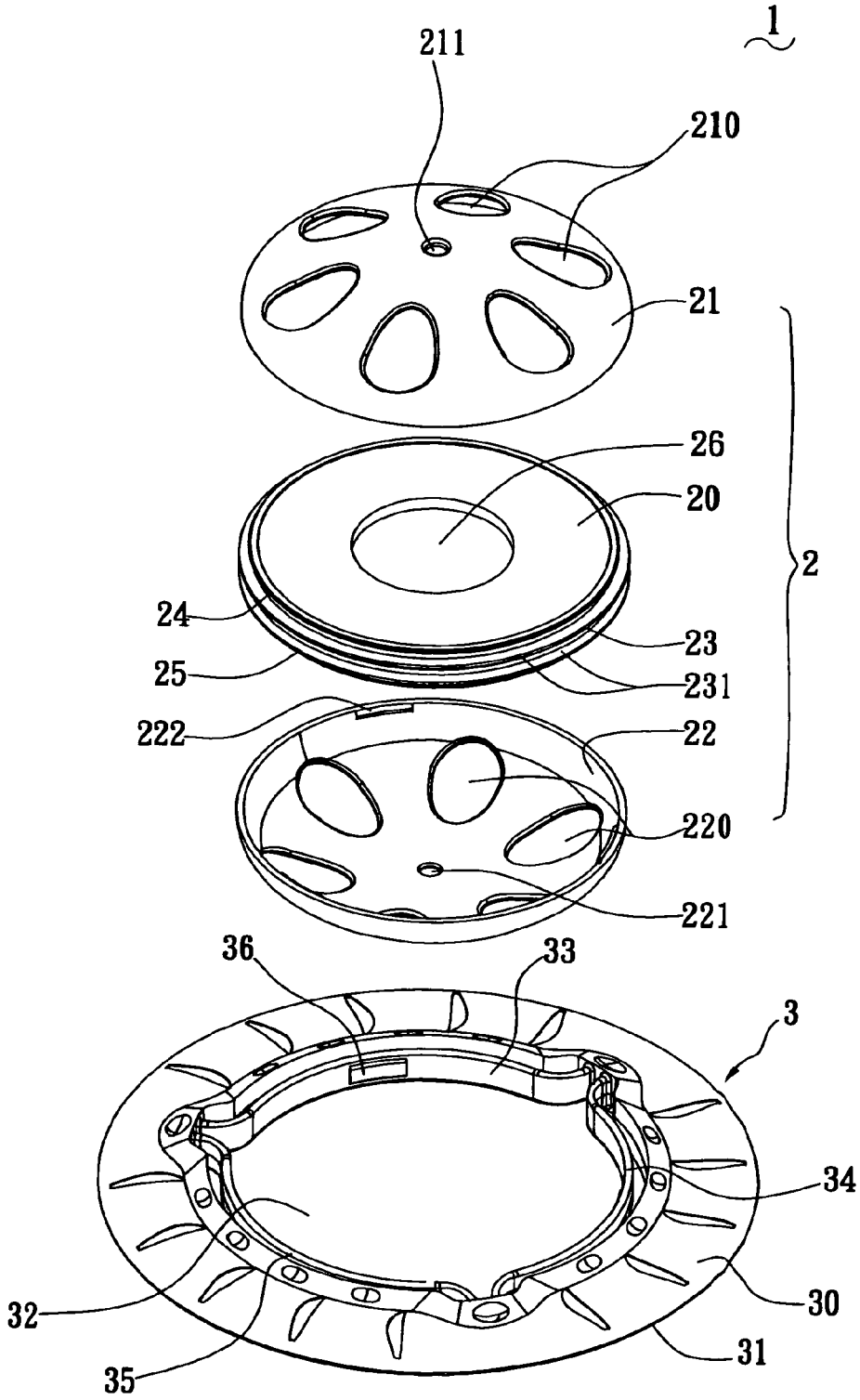
FIG. 1 is an exploded view of an aquatic amusement toy of the present invention.
Figure 2:
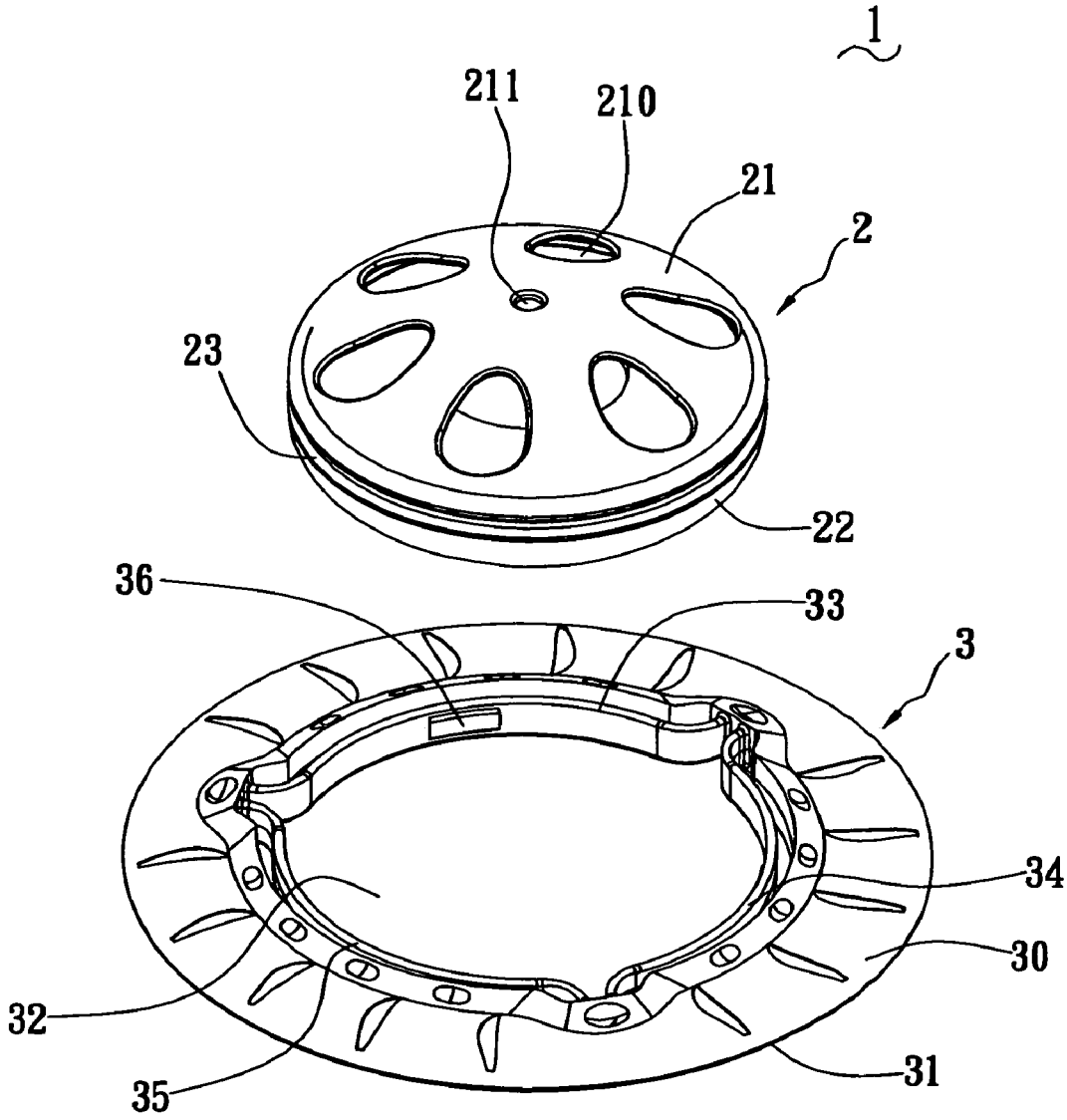
FIG. 2 is a part of assembled view of FIG. 1.
Figure 3:
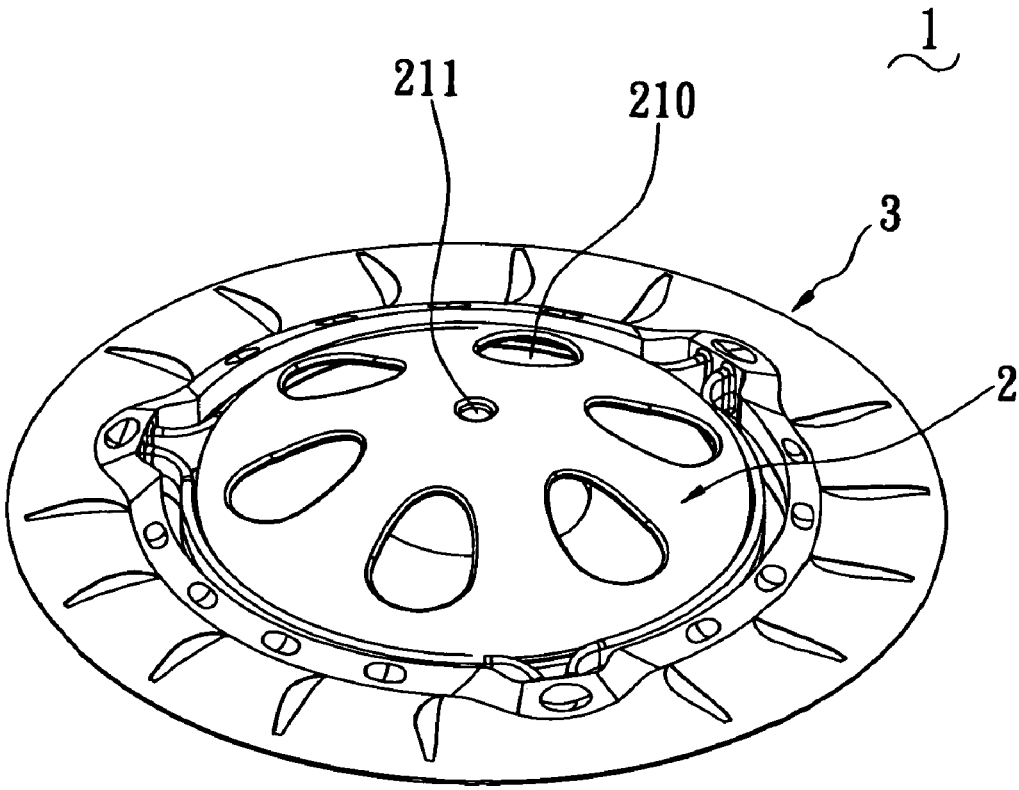
FIG. 3 is an assembled view of FIG. 2.
Figure 4:
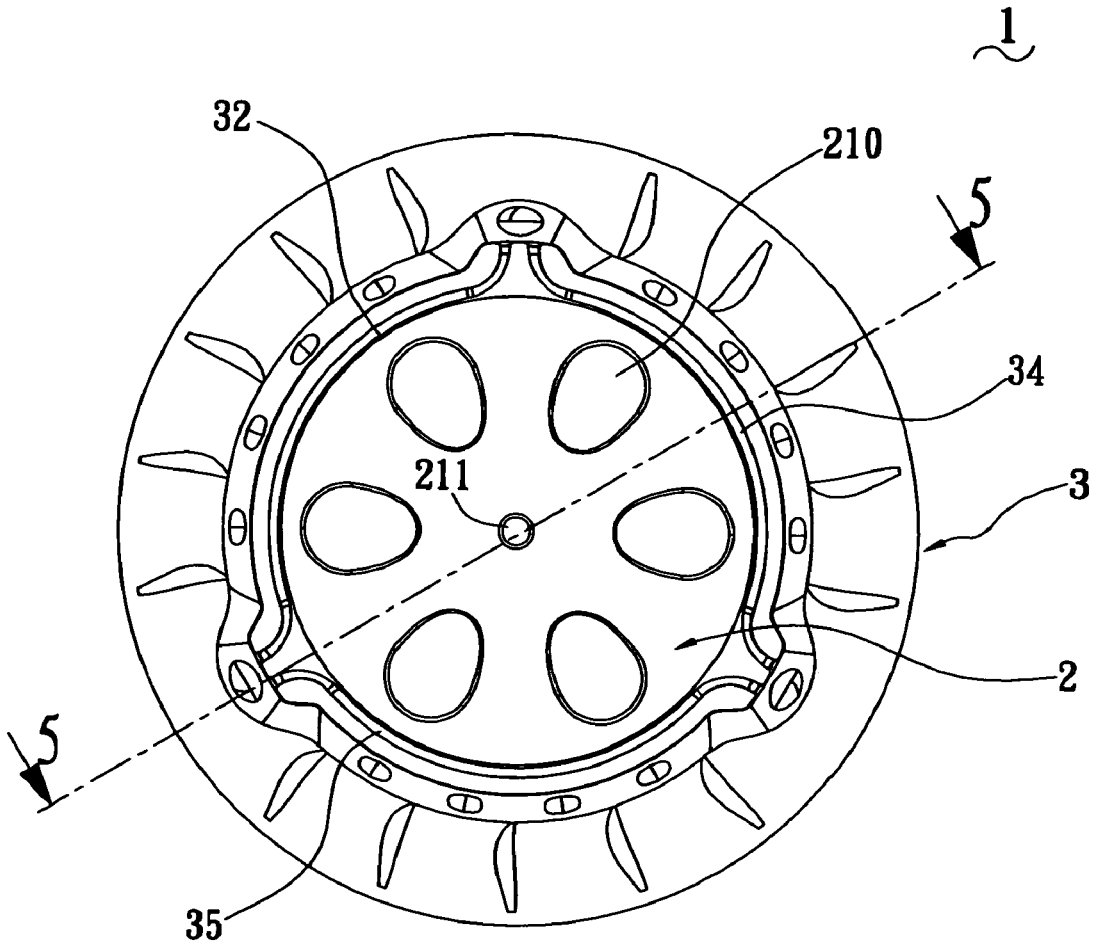
FIG. 4 is a top plan view of FIG. 3.
Figure 5:
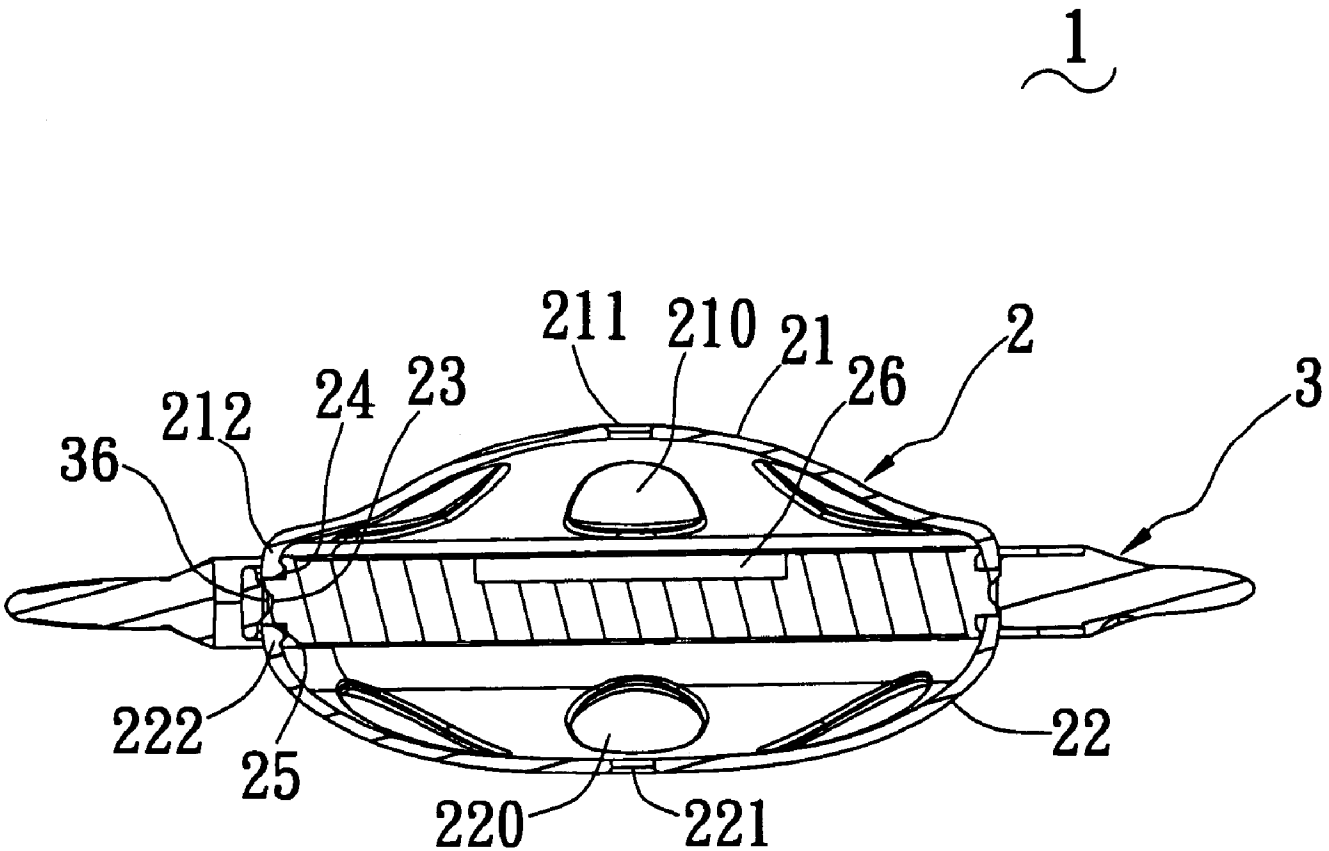
FIG. 5 is a cross-sectional view of FIG. 4 taken along line 5—5 in FIG. 4.
Figure 6:
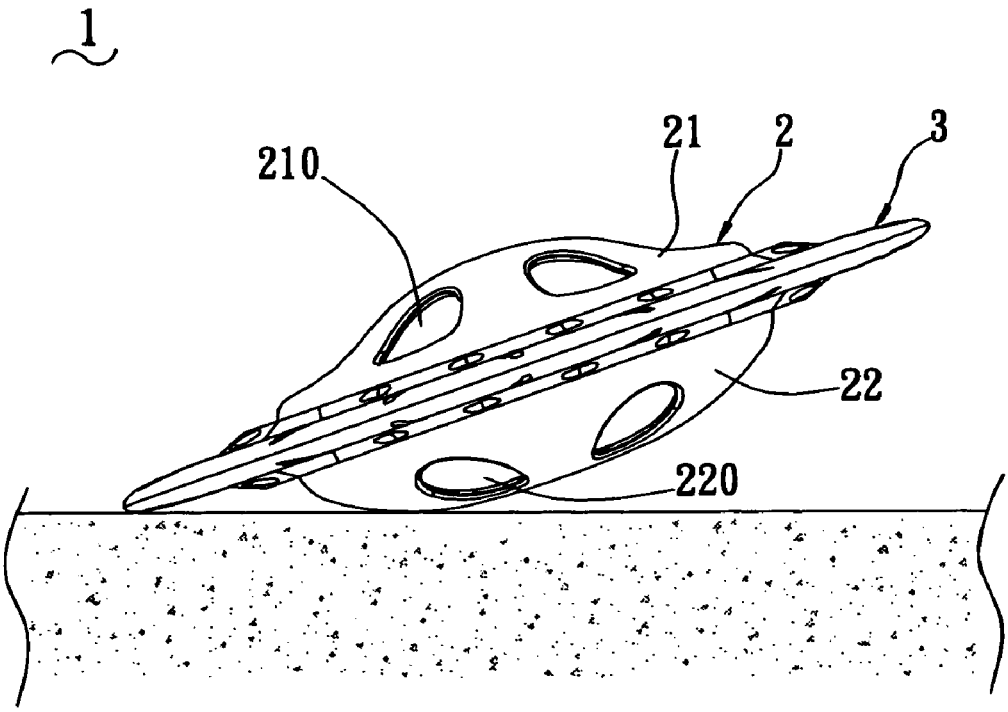
FIGS. 6 and 7 are a schematic view showing the assembled buoyant body and underwater member sink in water, and a buoyant body floating on water after the buoyant body is disengaged from an underwater member.

Referring to FIG. 1 to FIG. 3, an aquatic amusement toy 1 of the present invention comprises a buoyant body 2 and an underwater member 3, wherein the buoyant body 2 as shown in FIG. 1 includes a housing 20 made from floatable material, a first protruding shell 21 over the housing 20, a second protruding shell 22 under the housing 20 and an engaging portion 23 formed on lateral flanges of the housing 20. The engaging portion 23 in this embodiment is defined being a groove which is integrally formed therefrom, and an arcuate side 231 is formed from peripheral sides of the groove 23 for guiding the buoyant 2 to assemble easily with the underwater member 3. Furthermore, the engaging portion 23 includes a locking cavity 24, 25 abutting to ends of its lateral sides. The housing 20 has a recess 26 on a surface thereof which is relative to the first protruding shell 21 for placing a floatable material such as sponge to increase buoyancy of the buoyant body 2. The first and the second protruding shell 21, 22 respectively have a plurality of water guiding holes 210, 220 and a venting hole 211, 221 thereon, thus water can flow through the water guiding holes 210, 220 and the venting hole 211 can vent atmosphere in the buoyant when the aquatic amusement toy 1 sinks in water. Moreover, referring to FIG. 5, the first and the second protruding shell 21, 22 respectively have a barb 212, 222 corresponding to the locking cavity 24, 25 of the engaging portion 23 for coupling with the locking cavity 24, 25.

Referring to FIG. 1, The underwater member 3 is made from solid hard plastic or hollow hard plastic inside which material with a specific gravity thereof larger than that of water is filled. The underwater member 3 has a first and a second surface 30, 31 and a receiving portion 32 communicating through the first and second surface 30, 31 being engageable or disengageable with said engaging portion 23 of the buoyant body 2. A first receiving wall 33, a second receiving wall 34 and a third receiving wall 35 evenly spaced and extends hollowly from peripheral faces of the receiving portion 32 which cause the first, second and third receiving walls 33, 34, 35 being resilient and provide buffering space when the engaging portion 23 engage with the receiving portion 32. Additionally, the first, second and third receiving walls 33, 34, 35 respectively have a projection 36 protruding integrally therefrom for facilitating to engage with or disengage from the engaging portion 23.

Further referring to FIG. 1 to FIG. 6, in assembly, assemble the housing 20 together with the first protruding shell 21 and the second protruding shell 22 by the barbs 212, 222 engaging with the locking cavity 24, 25 (shown in FIG. 5), and then couple the buoyant body 2 with the receiving portion 32 of the underwater member 3. Thereby, the assembled buoyant body 2 and underwater member 3 sink in water and are kept a desired height above the bottom of the water through the first or second protruding shell 21, 22 (shown in FIG. 6).

Figure 7:
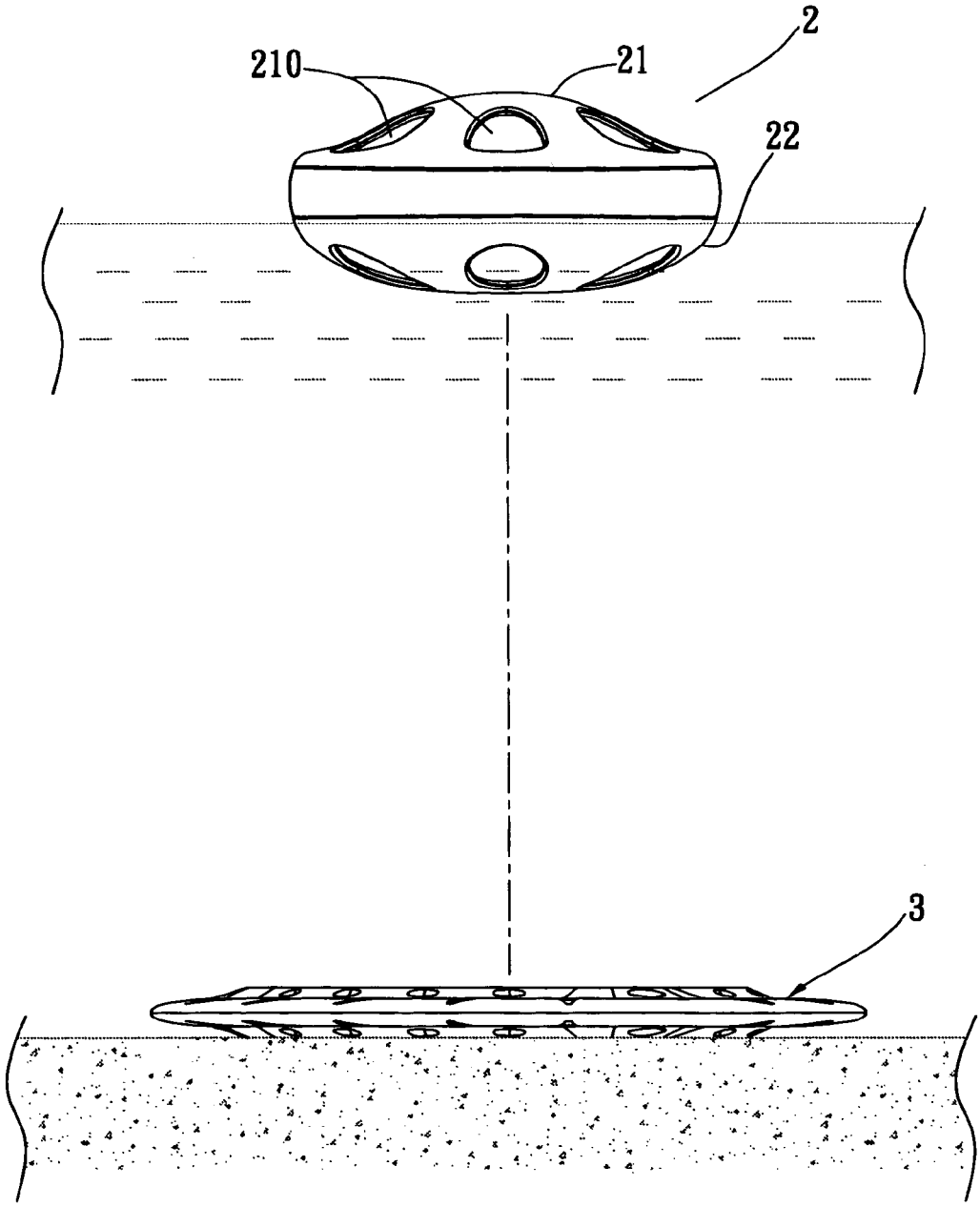

In use, the assembled aquatic amusement toy 1 is put underwater. Since the first or second protruding shell 21, 22 protrude from the first and the second surface 30, 31 of the underwater member 3, the aquatic amusement toy 1 are kept the desired height from the bottom of the water whatever the first or the second surface 30, 31 faces the bottom of the water. Accordingly, players may dive into water from a start to look for the aquatic amusement toy 1 and the one first finding the aquatic amusement toy 1 may depress the underwater member 3 to disengage the receiving portion 32 from the engaging portion 4. Thus the buoyant body 2 floats on the surface of the water (see FIG. 7) and the underwater member 3 is immersed in water thereby to indicate the winner has come out. Therefore, the aquatic amusement toy 1 of the present invention can be used in a diving game and make the game funny thereby facilitating diving exercise.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An aquatic amusement toy for an aquatic game in water comprising:

a buoyant body having a housing, a first protruding shell located over the housing, a second protruding shell located under the housing and an engaging portion formed on lateral flanges of the housing;

an underwater member having a first and a second surface and a receiving portion communicating through the first and second surface being selectively connected to and separated from said engaging portion of the buoyant body; and wherein, when the buoyant body is connected with the underwater member and placed in the water, the first protruding shell and the second protruding shell keep the buoyant body at a predetermined height above a bottom of the water, and when the underwater member is separated from the buoyant body, said buoyant body floats to a surface of the water and the underwater member sinks to the bottom of the water.

2. The aquatic amusement toy as claimed in claim 1, wherein a recess is defined on a surface of the housing relative to the first protruding shell.

3. The aquatic amusement toy as claimed in claim 2, wherein the first and the second protruding shell respectively have a plurality of water guiding holes and a venting hole thereon.

4. The aquatic amusement toy as claimed in claim 3, wherein the engaging portion is defined being a groove integrally formed therefrom, and an arcuate side is formed from peripheral sides of the groove.

5. The aquatic amusement toy as claimed in claim 4, wherein the first protruding shell and the second protruding shell are connected with the housing.

6. The aquatic amusement toy as claimed in claim 5, wherein the engaging portion further comprises two locking cavities, one of the two locking cavities is located on each of a top and a bottom of an outer periphery thereof.

7. The aquatic amusement toy as claimed in claim 6, wherein the first and the second protruding shell respectively have a barb corresponding to the two locking cavities of the engaging portion.

8. The aquatic amusement toy as claimed in claim 1, wherein an interior surface of the receiving portion is circular and the buoyant body has a circular outer periphery.

9. The aquatic amusement toy as claimed in claim 8, further comprising a first receiving wall, a second receiving wall and a third receiving wall evenly spaced and extending from the interior surface of the receiving portion.

10. The aquatic amusement toy as claimed in claim 9, wherein each of the first, second and third receiving walls of the receiving portion have a projection protruding inwardly therefrom.

* * * * *